United States Patent [19]

Flohr

[11] Patent Number: 4,723,474

[45] Date of Patent: Feb. 9, 1988

[54] PNEUMATIC STEPPING ACTUATOR POSITIONER

[75] Inventor: Mark C. Flohr, Irvine, Calif.

[73] Assignee: Smith International, Inc., Newport Beach, Calif.

[21] Appl. No.: 826,272

[22] Filed: Feb. 5, 1986

[51] Int. Cl.[4] ..... F15B 21/02; F15B 13/16

[52] U.S. Cl. ..... 91/36; 91/361; 91/365; 91/534; 251/29

[58] Field of Search ..... 91/35, 36, 38, 39, 40, 91/361, 365, 534, 459; 251/29

[56] References Cited

U.S. PATENT DOCUMENTS

| | | | |
|---|---|---|---|
| 1,658,965 | 2/1928 | Bradshaw et al. | 251/29 X |
| 3,017,865 | 1/1962 | Frantz et al. | 91/36 X |
| 3,129,719 | 4/1964 | Mollick | 251/29 X |
| 3,477,526 | 11/1969 | Jones et al. | 175/25 |
| 3,550,696 | 12/1970 | Kenneday | 175/25 |
| 3,677,353 | 7/1972 | Baker | 175/25 |
| 3,738,609 | 6/1973 | Divigaro | 91/361 X |
| 3,845,690 | 11/1974 | Ziegler | 91/35 |
| 3,906,726 | 9/1975 | Jameson | 175/24 X |
| 3,921,479 | 11/1975 | Katz | 91/534 X |
| 4,112,680 | 9/1978 | Grisebach | 91/40 X |
| 4,165,789 | 8/1979 | Rogers | 175/24 X |
| 4,481,768 | 11/1984 | Goshorn | 60/327 |

OTHER PUBLICATIONS

"Kuhnke Pneumatics", Catalog 1000, H. Kuhnke, Inc., p. 3.

*Primary Examiner*—Robert E. Garrett
*Assistant Examiner*—Mark A. Williamson
*Attorney, Agent, or Firm*—Christie, Parker & Hale

[57] ABSTRACT

A pneumatic control system for a reversible stepping actuator has an analog pneumatic control signal and an analog signal indicative of actual position of the actuator. Imbalance in these signals opens one or the other of a pair of comparator valves having inlets connected to a source of pneumatic pressure. Opening of either of the comparator valves enables a pulse timer which converts the pneumatic pressure from either of the comparator valves to pulses of pneumatic pressure applied to one or the other of the operators of the reversible stepping actuator. An oscillating pneumatic timer may be used to produce the pressure pulses, or an electric timer can be used to "chop" one of the pneumatic pressures into periodic pulses.

16 Claims, 2 Drawing Figures

PNEUMATIC STEPPING ACTUATOR POSITIONER

FIELD OF THE INVENTION

This invention relates to a control system which provides pulses of pneumatic pressure for operating a reversible stepping actuator such as used for setting a valve position.

BACKGROUND OF THE INVENTION

In some oil field applications it is desirable to employ a fluid powered reversible stepping actuator for setting a valve position. Such an actuator can be quite useful where the valve is in a remote location. For example, such a valve and actuator may be located at a sea floor wellhead with control provided from a platform or on-shore location.

A stepping actuator is desirable in many such applications because of the precise control easily obtainable. Such a stepping actuator may be used, for example, for rotating a valve stem just a few degrees for each step. The rotation of the stepping actuator may be only three degrees per pulse of pressure and if desired this can be geared down to rotate a valve stem. Thus, it is easy and straightforward to provide precise control of valve position.

An exemplary fluid powered reversible stepping actuator is described in U.S. Pat. No. 4,403,523. In such an actuator each pulse of pressure applied to the actuator rotates the valve stem through a known angle. So long as the pulse duration is above some minimum, the stepping actuator will move one increment and only one increment for each pulse, even though the pulse may be of long duration. Thus, excessive rotation of the stepping actuator is easily avoided.

It is desirable to provide a control system for such a reversible stepping actuator which provides pulses of pneumatic pressure with the pulse length and time interval between pulses being independently controllable. This assures that the actuator will execute each step regardless of delays in the lines between the control system and actuator. The control system should provide pulses that will drive the actuator in either direction as required to reach a desired setting.

It is often desirable that such a control system be entirely pneumatic. This can avoid use of electrical sensors and control devices where such usage is inconvenient or hazardous. It can often be desirable to have such a system operate only when a change in valve setting is desired, since in many applications a valve position may be set and remain unchanged for days or weeks. It is desirable in such a situation to have the control system stand by without power consumption.

It is desirable that such a system operate automatically in response to a control setting. That is, one should be able to provide a control signal indicative of a desired valve position and have the system automatically operate the stepping actuator until the desired position is reached. This eliminates need for manual adjustment of the valve and provides the option of either manually or automatically setting the desired valve position.

SUMMARY OF THE INVENTION

There is therefore provided in practice of this invention according to presently preferred embodiments, a pneumatic stepping actuator control system for a fluid operated stepping actuator having one operator for opening it and a second operator for closing it. A pulse timer is used for generating alternately an ON signal of controlled duration and an OFF signal of controlled duration. A normally closed pressure comparator valve having an inlet connected to a source of pneumatic pressure and an outlet connected to the pulse timer compares a pneumatic signal indicative of actual actuator position with a pneumatic control signal indicative of a desired actuator position. Similarly, a normally open pressure compensator valve having an inlet connected to the source of pneumatic pressure and outlet connected to the pulse timer compares such signals. The normally closed valve opens when the actual position signal is greater than the control signal and the normally open valve is kept closed under those conditions. The opposite occurs when the control signal is greater than the actual position signal. Pulses of pneumatic pressure corresponding to the ON signals are applied to the first operator when the normally closed valve is opened, thereby tending to move the actuator toward an open position. Likewise, pulses of pneumatic pressure corresponding to the ON signals are applied to the second operator when the normally open valve is open due to the control signal being greater than the actual pressure signal. Either a pneumatic timer subsystem or an electrical timer subsystem may be used.

BRIEF DESCRIPTION OF THE DRAWINGS

These and other features and advantages of the present invention will be appreciated as the same becomes better understood by reference to the following detailed description when considered in connection with the accompanying drawings wherein.

Figure 1:
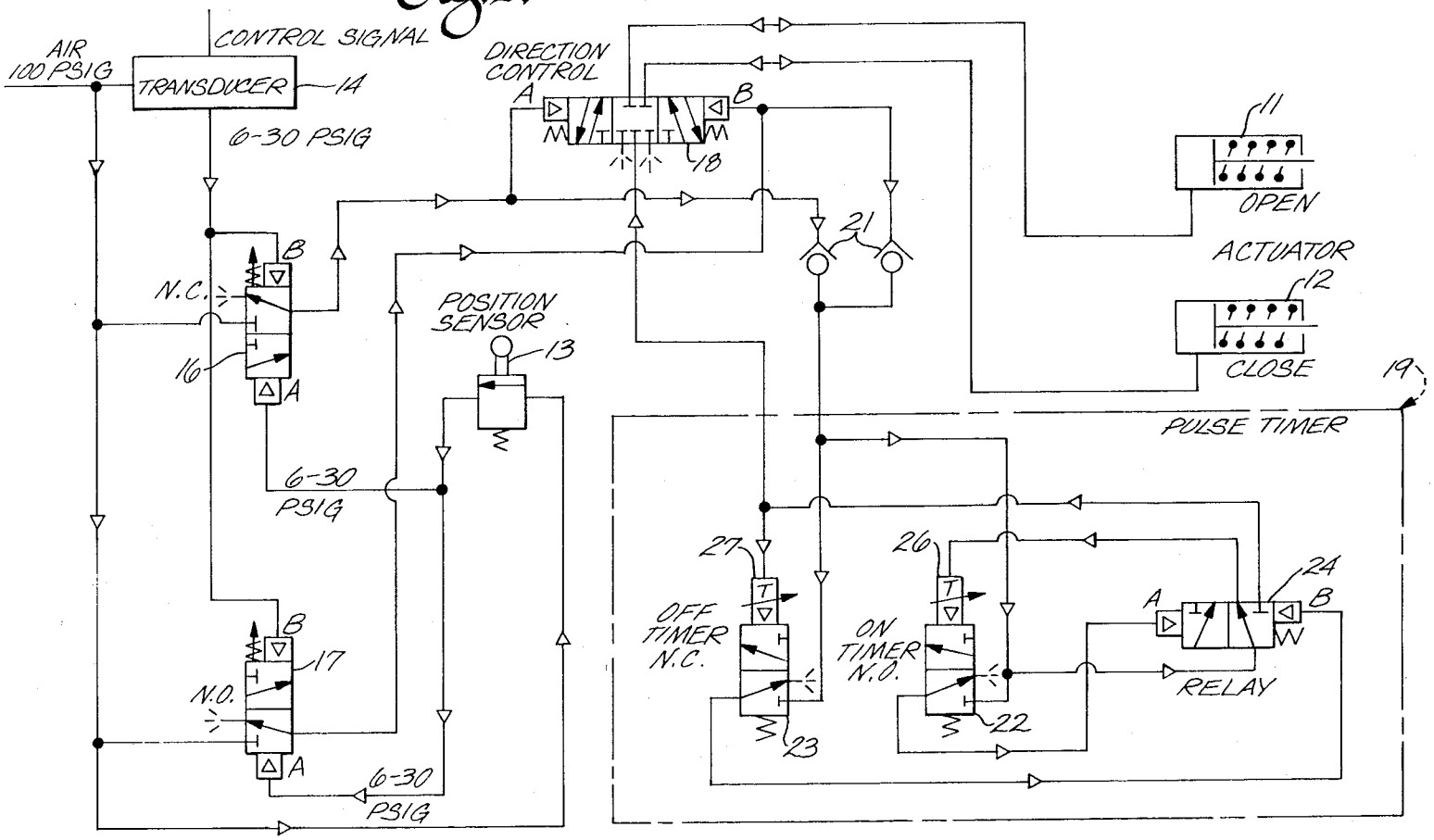
FIG. 1 is a pneumatic circuit diagram of a stepping actuator control system employing a pneumatic timer.

The drawings employ conventional graphic symbols for fluid power diagrams as specified in American National Standards/ANS Y32.10.

DETAILED DESCRIPTION

The pneumatic control system provided in practice of this invention operates a conventional reversible stepping actuator such as, for example, as described in U.S. Pat. No. 4,403,523. A typical stepping actuator has a cylinder and piston operator 11 for moving the actuator toward an open position. A similar pneumatic operator 12 moves the actuator toward a closed position. When pneumatic pressure is applied to one of the operators it causes the actuator to move one increment toward the opened or closed position. The actuator does not move an additional increment until the pressure is relieved and pressure is again applied to the operator.

An actuator position sensor 13 is mechanically connected to the actuator. In this embodiment the position sensor is a pneumatic pressure regulator having 100 PSIG air inlet. The output of the pressure regulator is an analog pneumatic signal in the range of from 6 to 30 PSIG. The lower pressure of this range indicates that the actuator is at its closed position and the higher pressure indicates that the actuator is at its open position. This signal indicative of the actual position of the actuator is compared with a pneumatic signal indicative of a desired actuator position. For example, an electrical control signal which can be generated manually or automatically is applied to a conventional transducer 14 which converts the electrical signal to an analog pneumatic signal in the range of 6 to 30 PSIG. Supply air at 100 PSIG is provided to the transducer to power the signal indicative of a desired actuator position. There is ample compressed air at oil field sites and such air can be used in the control system without special conditioning.

The supply air is also applied to the inlet of a normally closed pressure comparator valve 16 and the inlet of a normally open comparator valve 17. The control signal from the transducer 14 is applied to the B operator of the normally closed comparator valve and to the B operator of the normally open comparator valve. The signal indicative of actual actuator position from the regulator 13 is applied to the A operators of both the normally closed and normally open comparator valves 16 and 17.

The normally closed comparator valve is adjustably spring biased to a closed position. When the pressure of the actual position signal on the A operator is greater than the pressure of the control signal on the B operator, the normally closed comparator valve opens and remains open as long as the actual position signal is greater than the control signal. As will become apparent, opening of the normally closed comparator valve serves to apply pulses of pressure to the closing operator 12 of the stepping actuator. Thus, if the signal from the regulator 13 indicates that the actuator is open beyond the desired set point, pulses are applied toward closing the actuator.

The normally open comparator valve 17 is adjustably spring biased toward the open position. When the actual position signal on the A operator of this valve is greater than the control signal on the B operator, the valve is kept closed. If the actual position of the actuator is further closed than the desired set point, the control signal is greater than the actual position signal on the A operator. This permits the valve to open and, as will become apparent, causes pressure pulses to be applied to the opening operator 11 of the actuator.

When the actual position signal equals the control signal, indicating that the actuator is in its desired position, the normally closed comparator valve is closed and the normally open comparator valve is also closed. Thus, no changes occur in the actuator position.

The spring bias that maintains the normally closed valve in its closed position is adjustable so that the magnitude of the difference in pressure that causes the valve to open can be selected. By making a similar adjustment on the normally open comparator valve the "deadband" of the control system can be set. Thus, if the spring biases are adjusted so that it takes a pressure difference of 0.3 PSI to change a comparator valve, the error in the actual position of the actuator is larger than when the comparator valves are adjusted to change when the pressure difference is only 0.1 PSI, for example.

The output of the normally closed comparator valve is connected to a first operator of a three position, pilot-controlled, spring centered, direction control valve 18. Similarly the outlet of the normally open comparator valve 17 is applied to the other operator of the three position direction control valve. When the comparator valves are in their closed positions, the respective operators of the direction control valve are vented, and the direction control valve remains centered and closed. The outlets of both comparator valves are applied to an oscillating pulse timer subsystem 19 by way of check valves 21. Thus when either of the comparator valves is open, the 100 PSI supply air is applied to the pulse timer. The pulse timer provides periodic pulses of pneumatic pressure with control of both the duration of the pressure pulse and the duration of the interval between successive pressure pulses.

The pneumatic pulse timer comprises an ON timer valve 22, on OFF timer valve 23 and a bi-stable timer relay valve 24. The ON timer valve and OFF timer valve are identical. Each timer valve is a spring biased, pneumatically operated three-way valve. Supply air from the check valves 21 is applied to an inlet of each timer valve. The other "inlet" of each timer valve is a vent. The timer valves are spring biased so that they are normally closed, with the valve outlet connected to the vent. Each timer valve has an adjustable timed pneumatic operator 23, 27. When pneumatic pressure is applied to one of the timed operators, a timer is started. At the end of a selected interval the respective operator causes the timer valve to switch to its open position. When the valve has been opened for a short interval (typically a fraction of a second) it again closes.

The outlet of the ON timer valve 22 is connected to the A operator of the timer relay valve 24. Similarly the outlet of the OFF timer valve 23 is connected to the B operator of the timer relay valve. Supply air from the check valves is also connected to the inlet of the timer relay valve. One outlet of the timer relay valve is connected to the operator 26 of the ON timer valve and the other outlet is connected to the operator 27 of the OFF timer valve. One outlet of the relay, in this case the one to the OFF timer operator, is connected to the inlet of the direction control valve 18 to provide periodic pressure pulses. It will become apparent that periodic pressure pulses are available at either outlet from the timer relay valve because of the symmetry of the pneumatic timer system.

Assuming that the pulse timer system 19 is in the state illustrated when one of the comparator valves is opened, air pressure is applied by way of the timer relay valve to the operator 26 of the ON timer valve. This starts the timer of the ON valve and after its set interval, the ON timer valve opens. Opening of the ON timer valve applies supply air pressure to the A operator of the timer relay valve. This causes the timer relay valve to shuttle to its other position.

In this second position of the relay valve, pressure is shut off from the operator of the ON timer valve and in a fraction of a second the ON timer valve again closes. Air pressure is instead applied to the operator 27 of the OFF timer valve. This starts the timed cycle of the OFF timer and at the end of its preset interval, the OFF timer valve opens. Opening of the OFF timer valve applies pneumatic pressure to the B operator of the timer relay, shifting it back towards its initial state. (The A operator of the timer relay valve is vented through the ON timer valve, which is then in its closed position, to permit free shuttling of the relay valve). Shuttling the timer relay valve back to its initial position cuts off air pressure to the OFF timer operator. Pressure in the connecting lines drops off quickly through the OFF timer operator and the OFF timer valve reverts to its closed position.

The shuttling of the timer relay valve to its initial state also applies pneumatic pressure to the ON timer operator 26 to restart the cycle. The free running timer system continues to repeat the cycle as long as air pressure is applied through the check valves, thereby providing periodic pneumatic pressure pulses to the inlet of the direction control valve.

The length of the pressure pulse in the illustrated embodiment is determined by the time setting of the OFF timer operator. In effect the ON timer valve turns on the pulse and the OFF timer valve turns off the pulse. Similarly, the interval between pulses is determined by the time period set at the ON timer operator. In an exemplary embodiment, the OFF timer operator might be set at two seconds or more to assure adequate time for the pressure pulse to build up in the operator of the actuator and cause the actuator to step one interval. If the pneumatic line to the actuator is long, a longer duration of pulse may be used. The interval between pulses set on the ON timer operator may be two or more seconds to assure that pressure is relieved on the respective operator and the position sensor signal has had time to change before the next pulse.

The pulse timer operates only when one of the comparator valves is open. Otherwise there is no air pressure applied to it to cause it to operate. When the pulse timer is running, pulses of pneumatic pressure are applied to the inlet of the direction control valve. This valve is normally closed; however, when air pressure is applied to the pulse timer, the valve is also open in one position or the other.

In the event the normally closed comparator valve is open, air pressure is applied to the A operator of the direction control valve. This opens the control valve so that pulses of pneumatic pressure are applied to the closing operator 12 of the actuator. When the valve is in this position, the opening operator 11 of the actuator is vented through the control valve. Thus, as long as the normally closed comparator valve is open, pulses of pneumatic pressure cause incremental movement of the actuator towards its closed position. When the position sensor indicates that the actual position of the actuator corresponds to the desired position as indicated by the control signal, the normally closed valve closes, which both closes the direction control valve 18 and shuts down the pulse timer.

Likewise, when the normally open comparator valve 17 is open, air pressure is applied to the B operator of the direction control valve and the pulse timer. This causes the direction control valve to open so that pulses of pneumatic pressure are applied to the opening operator of the actuator and the closing operator is vented.

It is desirable that the pulse timer operate only when pneumatic pulses are needed for operating the stepping actuator. In most applications of such equipment, the actuator is operated only occasionally and long periods may elapse between changes of valve position. During such periods there is no reason to run the pulse timer, with concomitant wear and slight release of compressed air.

Figure 2:
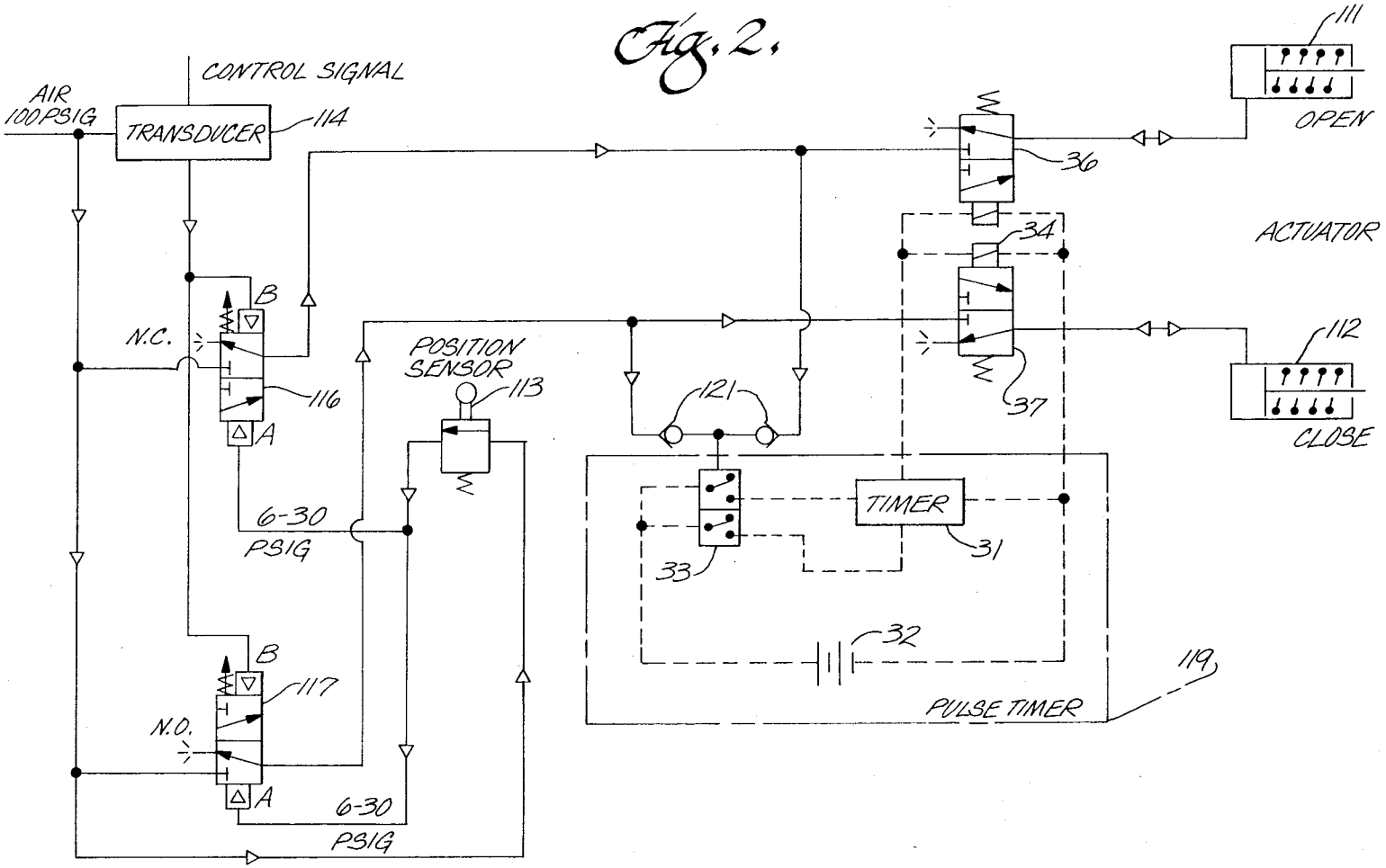
FIG. 2 is a pneumatic circuit diagram of a stepping actuator control system employing an electrical timer.

FIG. 2 illustrates schematically another embodiment of control system for a reversible stepping actuator constructed according to principles of this invention. Portions of this system are identical to the embodiment illustrated in FIG. 1 and like components have been identified with references numbers 100 larger than the corresponding reference numbers in FIG. 1. Thus, for example, the actuator position sensor 13 in FIG. 1 corresponds exactly to the position sensor 113 in FIG. 2. Since the actuator operators 111 and 112, the signal transducer 114 and the comparator valves 116 and 117 operate identically to the corresponding components described with respect to FIG. 1, a redundant description of their operation is omitted.

The pulse timer 119 comprises a conventional adjustable electrical timer 31 which in this embodiment operates from a source 32 of 24 volt direct current. Clearly other power supplies could be used but the low voltage is desirable for safety reasons. The electrical timer 31 is enabled by a pneumatically operated single throw, double contact switch 33. When either of the comparator valves 116 or 117 is open, pneumatic pressure is applied through the check valves 121 for closing the normally open enabling switch 33. Closing the switch applies current to the timer for enabling its operation. Such a timer is adjustable to provide an ON signal of a desired duration and an interval (or OFF signal) of a desired duration between ON signals. When the timer is on it applies current to the solenoids 34 of a pair of normally closed solenoid valves 36, 37. Thus, when the electrical timer is in the ON portion of its cycle, the solenoid valves are both open, and when the timer is off both solenoid valves are closed.

The inlet to one of the solenoid valves 36 comes from the normally closed comparator valve 116. The outlet of that solenoid valve is connected to the opening operator 111 of the actuator. The inlet to the other solenoid valve 37 comes from the normally open comparator valve 117 and the outlet of the solenoid valve is connected to the closing operator 112 of the actuator. When the solenoid valves are closed the actuator operators are vented. When the solenoid valves are open, the operators are connected directly to the respective comparator valves.

When the actuation position sensor shows that the actual position differs from the desired position, one of the comparator valves is opened as hereinabove described. The resultant air pressure enables the pulse timer, which causes the two solenoid valves to periodically open and close for intervals as provided by the adjustable timer. Pneumatic pressure from the comparator valve that is open is thereby applied to the corresponding actuator operator. The other of the actuator operators is vented through the solenoid valve and other of the comparator valves.

For example, if the normally closed comparator valve 116 is open, pneumatic pressure is applied to the opening operator 111 of the actuator each time the solenoid valves open. The closing operator 112 is continually vented, either directly through the vent of its solenoid valve 37 or through the vent of the normally open comparator valve 117.

In both embodiments of the control system, the reversible actuator is operated directly by pneumatic pressure. In the event a hydraulic actuator is desired, the pneumatic pressure pulses otherwise applied directly to the actuator operators are applied to pneumatically operated hydraulic valves which in turn operate the actuator.

In the illustrated embodiments the actuator position sensor comprises a pressure regulator mechanically coupled to the actuator to provide an analog pressure signal indicative of actual position of the actuator. If desired an electrical sensor can be coupled to the actuator with its signal applied to an electrical pneumatic transducer (similar to the transducer 14) to produce a pneumatic signal for application to the comparator valves.

Specific pneumatic devices are illustrated for implementing this invention. It will be apparent that substitutions can be made without departing from principles of this invention. For example, in the embodiment illustrated in FIG. 1, instead of a single three-position direction control valve, separate valves could be connected to each source of pneumatic pressure from the respective comparator valves. Similarly in the embodiment illustrated in FIG. 2, instead of using separate solenoid valves 36 and 37, a single four-way valve can be used.

It will be apparent that many other modifications and variations can be made in practice of this invention. It is therefore to be understood that within the scope of the appended claims, this invention may be practiced otherwise than as specifically described.

What is claimed is:

1. A pneumatic reversible stepping actuator control system comprising:

means for generating an actual actuator position signal;

means for generating a desired actuator position signal;

means for comparing the actual position signal and the desired position signal and producing a first pneumatic pressure when the desired position signal is greater, and a second pneumatic pressure when the actual position signal is greater;

an oscillating pneumatic timer;

means for connecting the first pneumatic pressure to the timer and means for connecting the second pneumatic pressure to the timer for converting either the first pneumatic pressure or the second pneumatic pressure to periodic pulses of pneumatic pressure;

means for applying the pulses of pneumatic pressure to a first operator of such a reversible stepping actuator when the desired position signal is greater; and means for applying the pulses of pneumatic pressure to a second operator of such a reversible stepping actuator when the actual position signal is greater.

2. A pneumatic reversible stepping actuator control system comprising:

means for generating an actual actuator position signal;

means for generating a desired actuator position signal;

means for comparing the actual position signal and the desired position signal and producing a first pneumatic pressure when the desired position signal is greater, and a second pneumatic pressure when the actual position signal is greater;

means for generating periodic pulses of pneumatic pressure comprising an oscillating pneumatic timer actuated by either the first or second pneumatic pressure for converting either pneumatic pressure to periodic pulses of pneumatic pressure;

means for applying the pulses of pneumatic pressure to a first operator of such a reversible stepping actuator when the desired position signal is greater comprising a first normally closed valve means connecting the timer output to the first operator and means for opening the first valve means in response to the first pneumatic pressure; and means for applying the pulses of pneumatic pressure to a second operator of such a reversible stepping actuator when the actual position signal is greater comprising a second normally open valve means connecting the timer output to the second operator and means for opening the second valve means in response to the second pneumatic pressure.

3. A pneumatic reversible stepping actuator control system comprising:

means for generating an actual actuator position signal;

means for generating a desired actuator position signal;

means for comparing the actual position signal and the desired position signal and producing a first pneumatic pressure when the desired position signal is greater, and a second pneumatic pressure when the actual position signal is greater;

means for generating periodic pulses of pneumatic pressure comprising an oscillating pneumatic timer actuated by either the first or second pneumatic pressure for converting either pneumatic pressure to periodic pulses of pneumatic pressure;

means for applying the pulses of pneumatic pressure to a first operator of such a reversible stepping actuator when the desired position signal is greater; and means for applying the pulses of pneumatic pressure to a second operator of such a reversible stepping actuator when the actual position signal is greater and wherein the timer comprises:

a normally closed ON valve;

ON timer means for temporarily opening the ON valve at the end of a first selected timed interval;

a normally closed OFF valve;

OFF timer means for temporarily opening the OFF valve at the end of a second selected timed interval;

a bi-stable relay valve;

means for connecting either the first or second pneumatic pressure to the inlets of the ON valve, the OFF valve and the relay valve;

means for connecting the outlet of the OFF valve to a first operator of the relay valve for shifting the relay valve to a first state;

means for connecting the outlet of the ON valve to a second operator of the relay valve for shifting the relay valve to a second state;

a first outlet from the relay valve connected to the OFF timer means, the first state of the relay valve connecting the inlet and the first outlet for operating the OFF timer means; and a second outlet from the relay valve connected to the ON timer means, the second state of the relay valve connecting the inlet and the second outlet for operating the ON timer means, so that at least one of the outlets of the relay valve provides pulses of pneumatic pressure.

4. A pneumatic reversible stepping actuator control system comprising:

a pneumatic pressure regulator mechanically coupled to the actuator for converting actual position to an analog pneumatic signal for generating an actual actuator position signal;

means for generating a desired actuator position signal;

means for comparing the actual position signal and the desired position signal and producing a first pneumatic pressure when the desired position signal is greater, and a second pneumatic pressure when the actual position signal is greater;

means for converting either pneumatic pressure to periodic pulses of pneumatic pressure;

means for applying the pulses of pneumatic pressure to a first operator of such a reversible stepping actuator when the desired position signal is greater; and means for applying the pulses of pneumatic pressure to a second operator of such a reversible stepping actuator when the actual position signal is greater.

5. A pneumatic reversible stepping actuator control system comprising:

means for generating an actual actuator position signal;

means for generating a desired actuator position signal;

means for comparing the actual position signal and the desired position signal and producing a first pneumatic pressure when the desired position signal is greater, and a second pneumatic pressure when the actual position signal is greater;

means for converting either pneumatic pressure to periodic pulses of pneumatic pressure;

means for applying the pulses of pneumatic pressure to a first operator of such a reversible stepping actuator when the desired position signal is greater; and means for applying the pulses of pneumatic pressure to a second operator of such a reversible stepping actuator when the actual position signal is greater; and wherein The position signals each comprise a pneumatic pressure signal and the means for comparing comprises:

first pneumatic comparator valve means having an inlet connected to a source of pneumatic pressure;

second pneumatic comparator valve means having an inlet connected to a source of pneumatic pressure; and means for connecting the desired position signal and the actual position signal to both comparator valve means for selectively opening the first comparator valve means fwhen the desired position signal is greater or opening the second comparator valve means when the actual position signal is greater.

6. A control system as recited in claim 5 wherein the means for applying the pulses of pneumatic pressure to the operators comprises:

direction control valve means having an inlet connected to the means for converting pneumatic pressure to pressure pulses and having first and second outlets connected to the first and second operators, respectively; and means for shifting the direction control valve means to the first outlet when the desired position signal is greater and shifting the direction control valve means to the second outlet when the actual position signal is greater.

7. A pneumatic reversible stepping actuator control system as recited in claim 6 wherein the means for converting either pneumatic pressure into periodic pulses of pneumatic pressure comprises:

solenoid valve means between the first and second pneumatic pressures and the first and second operators respectively of the reversible stepping actuator;

an electric timer for alternatively opening and closing the solenoid valve means and;

means for enabling the electric timer in response to either the first pneumatic pressure or the second pneumatic pressure for applying pulses of one of said pneumatic pressures to the respective operator.

8. A pneumatic reversible stepping actuator control system comprising:

means for generating an analog pneumatic signal corresponding to actual actuator position;

means for generating an analog control signal corresponding to a desired actuator position signal;

a normally closed comparator valve having an inlet connected to a source of pneumatic pressure;

a normally open comparator valve having an inlet connected to a source of pneumatic pressure;

means for connecting the control signal and the actual position signal to the normally closed valve for keeping the valve closed when the two signals are equal and for opening the valve when the actual position signal is greater than the control signal;

means for connecting the actual position signal and the control signal to the normally open comparator valve for keeping the valve closed when the signals are equal and opening the valve when the control signal is a first operator for stepping a reversible actuator in one direction;

a second operator for stepping the actuator in the opposite direction;

a direction control valve having an inlet connected to pneumatic pressure pulses from the pulse timer, a first outlet connected to the first operator and a second outlet connected to the second operator;

means for connecting the outlet of the normally closed comparator valve to the direction control valve for opening its inlet to the second outlet and venting the first outlet when the normally closed comparator valve is open; and means for connecting the outlet of the normally open comparator valve to the direction control valve for opening its inlet to the first outlet and venting the second outlet when the normally open comparator valve is open.

9. A control system as recited in claim 8 wherein the timer comprises:

a normally closed ON valve;

ON timer means for temporarily opening the ON valve at the end of a first selected timed interval;

a normally closed OFF valve;

OFF timer means for temporarily opening the OFF valve at the end of a second selected timed interval;

a bi-stable relay valve;

means for connecting either the first or second pneumatic pressure to the inlets of the ON valve, the OFF valve and the relay valve;

means for connecting the outlet of the OFF valve to a first operator of the relay valve for shifting the relay valve to a first state;

means for connecting the outlet of the ON valve to a second operator of the relay valve for shifting the relay valve to a second state;

a first outlet from the relay valve connected to the OFF timer means, the first state of the relay valve connecting the inlet and the first outlet for operating the OFF timer means; and a second outlet from the relay valve connected to the ON timer means, the second state of the relay valve connecting the inlet and the second outlet for operating the ON timer means, so that at least one of the outlets of the relay valve provides pulses of pneumatic pressure.

10. A control system as recited in claim 8 wherein the means for generating an actual actuator pressure signal comprises a pneumatic pressure regulator mechanically coupled to the actuator for converting actual position to an analog pneumatic signal.

11. A pneumatic reversible stepping actuator control system comprising:

means for generating an analog pneumatic signal corresponding to actual actuator position;

means for generating an analog control signal corresponding to a desired actuator position signal;

a normally closed comparator valve having an inlet connected to a source of pneumatic pressure;

a normally open comparator valve having an inlet connected to a source of pneumatic pressure;

means for connecting the control signal and the actual position signal to the normally closed valve for keeping the valve closed when the two signals are equal and for opening the valve when the actual position signal is greater than the control signal;

means for connecting the actual position signal and the control signal to the normally open comparator valve for keeping the valve closed when the signals are equal and opening the valve when the control signal is greater than the actual position signal;

an electric timer for generating an ON signal of controlled duration and an OFF signal of controlled duration;

first solenoid means interconnecting the outlet of the normally closed comparator valve and a first operator of a reversible stepping actuator for stepping the actuator in one direction;

second solenoid means interconnecting the outlet of the normally open comparator valve with a second operator of the actuator for stepping the actuator in the opposite direction;

means for connecting the outlets of both the comparator valves to the timer for enabling the timer; and means for connecting the timer to both solenoid valve means for opening both solenoid valves in response to the ON signal and closing both solenoid valves in response to the OFF signal.

12. A control system as recited in claim 11 wherein the means for generating an actual actuator pressure signal comprises a pneumatic pressure regulator mechanically coupled to the actuator for converting actual position to an analog pneumatic signal.

13. A pneumatic control system for a reversible stepping actuator comprising:

means for generating an analog pneumatic signal indicative of actual actuator position;

means for generating an analog pneumatic control signal corresponding to a desired actuator position;

comparator valve means having a pair of inlets connected to a source of pneumatic pressure and connected to the pneumatic signals for remaining closed when the signals are equal and opening one of the valve means when the signals are unequal;

means for converting the pneumatic pressure from either of the open valve means to periodic pulses of pneumatic pressure; and means for applying such pressure pulses to the operators of a reversible stepping actuator for stepping the actuator.

14. A control system as recited in claim 13 wherein the means for converting comprises an oscillating pneumatic timer connected to the pneumatic pressure from either of the valve means.

15. A control system as recited in claim 13 wherein the means for converting and the means for applying comprise:

an oscillating electric timer for producing an ON signal of controlled duration and an OFF signal having a controlled interval between successive ON signals; and solenoid valve means connected to the timer to open in response to an ON signal and close in response to an OFF signal, and interconnecting the comparator valve means and the actuator.

16. A control system as recited in claim 13 comprising a control valve for applying the pressure pulses to the actuator and means for opening the control valve in one direction when the control signal is greater than the actual position signal and for opening the control valve in the other direction when the actual position signal is greater than the control signal.

* * * * *

UNITED STATES PATENT AND TRADEMARK OFFICE

CERTIFICATE OF CORRECTION

PATENT NO. : 4,723,474

DATED : February 9, 1988

INVENTOR(S) : Mark C. Flohr

It is certified that error appears in the above-identified patent and that said Letters Patent is hereby corrected as shown below:

Column 10, line 24, after "signal is" insert
-- greater than the actual position signal;
an oscillating pneumatic timer for generating periodic pulses of pneumatic pressure;
means for connecting the inlet of the pulse timer to the outlets of the first and second comparator valves; --

Signed and Sealed this

Thirtieth Day of August, 1988

*Attest:*

*Attesting Officer*

DONALD J. QUIGG

*Commissioner of Patents and Trademarks*